United States Patent [19]

Bierbach et al.

[11] 4,211,539

[45] Jul. 8, 1980

[54] PRODUCING PURE GAS OF HIGH CALORIFIC VALUE FROM GASIFICATION OF SOLID FUEL

[75] Inventors: Herbert Bierbach, Frankfurt am Main; Rudolf Kohlen, Wehrheim; Carl Hafke, Frankfurt am Main, all of Fed. Rep. of Germany

[73] Assignee: Metallgesellschaft Aktiengesellschaft, Frankfurt am Main, Fed. Rep. of Germany

[21] Appl. No.: 923,508

[22] Filed: Jul. 10, 1978

Related U.S. Application Data

[63] Continuation of Ser. No. 790,368, Apr. 25, 1977, abandoned.

[30] Foreign Application Priority Data

May 26, 1976 [DE] Fed. Rep. of Germany ..... 2623489

[51] Int. Cl.[2] ..... C10J 3/16

[52] U.S. Cl. ..... 48/197 R; 48/206; 55/85; 60/39.02

[58] Field of Search ..... 48/197 R, 201, 202, 48/203, 206, 210; 252/373; 201/38; 60/39.02; 55/85, 92, 94

[56] References Cited

U.S. PATENT DOCUMENTS

| | | | |
|---|---|---|---|
| 2,111,579 | 3/1938 | Winkler et al. | 48/203 |
| 2,701,758 | 2/1955 | Danulat et al. | 48/206 |
| 3,069,250 | 12/1962 | Weittenhiller et al. | 48/197 R |
| 3,540,867 | 11/1970 | Baron et al. | 48/197 R |
| 3,607,157 | 9/1971 | Schlinger et al. | 48/206 |
| 3,746,522 | 7/1973 | Donath | 48/202 |
| 4,007,019 | 2/1977 | Slater et al. | 48/197 R |
| 4,087,258 | 5/1978 | Baron et al. | 48/197 R |

OTHER PUBLICATIONS

Clean Fuels from Coal Symposium Papers, 9-1973, Krieb, pp. 127 and 131, Igt.

*Primary Examiner*—S. Leon Bashore
*Assistant Examiner*—Peter F. Kratz
*Attorney, Agent, or Firm*—Sprung, Felfe, Horn, Lynch & Kramer

[57] ABSTRACT

A process of producing a gas of high calorific value and low dust content comprising contacting coal with water vapor and free oxygen at a pressure of about 5 to 150 bars and a temperature sufficient to produce a gas containing hydrogen and carbon monoxide, containing at least about 10 grams of dust per standard cubic meter and having a temperature of about 350° to 800° C., subjecting the gas to a coarse purification to reduce the solids content thereof, then scrubbing the gas at about 200° to 300° C. with a liquid predominantly comprising hydrocarbons and including less than about 5% of water by weight, and withdrawing a purified gas substantially free of solids and having an enhanced calorific value. In accordance with preferred features, the coarse purification stage includes at least one cyclone separator, the gas leaves the coarse purification stage at a temperature above about 350° C. and is cooled by spraying with water to below 350° C. before entering the intense scrubbing stage.

6 Claims, 1 Drawing Figure

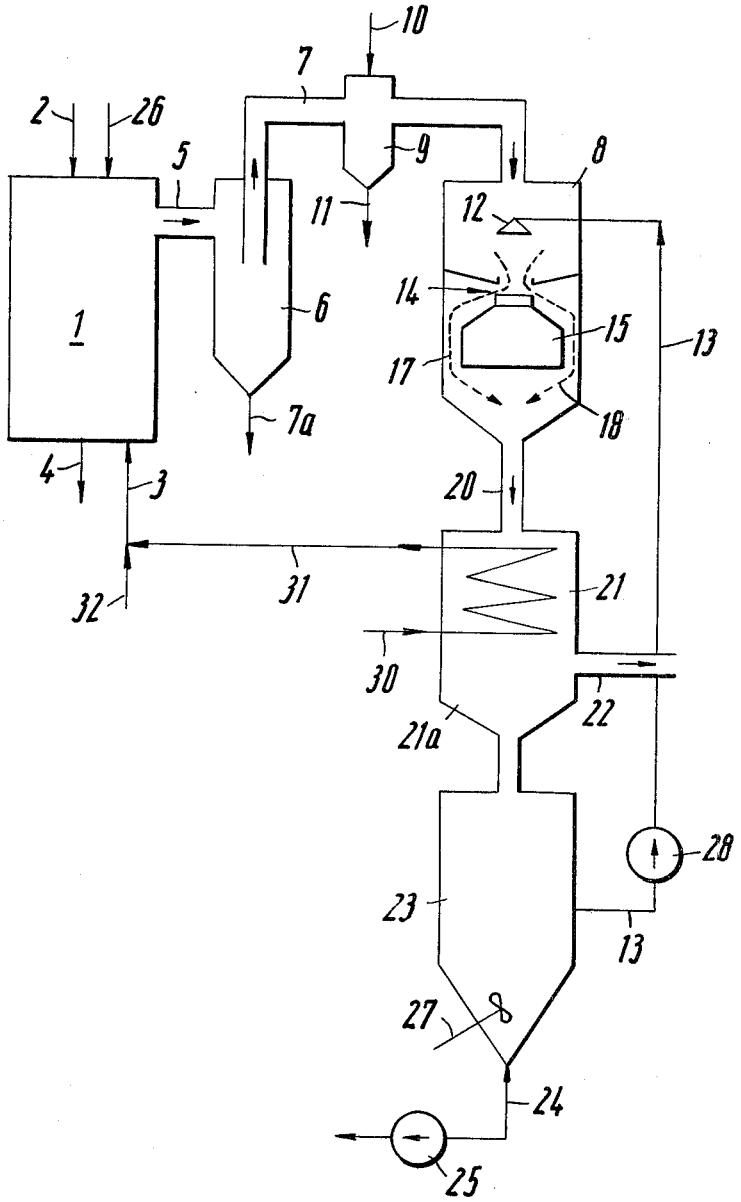
10
7
2
26
5
9
8
11
12
1
6
14
15
13
17
7a
18
4
3
20
31
32
21
30
22
21a
28
23
13
27
24
25

PRODUCING PURE GAS OF HIGH CALORIFIC VALUE FROM GASIFICATION OF SOLID FUEL

This is a continuation of application Ser. No. 790,368, filed Apr. 25, 1977, now abandoned.

This invention relates to a process of producing a gas which has a high calorific value and a low dust content from a solid-laden raw gas, which is at a temperature of 350° to 800° C. and has been produced by a gasification of solid fuel, preferably coal, in a gasification reactor under a pressure of 5 to 150 bars by a treatment with gaseous gasifying agents which comprise water vapor and free oxygen.

The gasification of solid fuels, such as mineral coal or peat, under superatmospheric pressure has been known for a long time. Details of the pressure gasification process and of gasification reactors which are suitable for that process have been described, e.g., in U.S. Pat. Nos. 2,667,409; 3,930,811 (German DOS No. 2,351,963); 3,902,872 (DOS No. 2,352,900); 3,937,620 (DOS No. 2,346,833); and 3,951,616 (DOS No. 2,353,241). The gasification reactors described there are known in the art as "LURGI Pressure Gas Producers".

In the known processes, solid fuel is gasified under superatmospheric pressure in a fixed bed by a treatment with oxygen and water vapor as gasifying agents. Carbon dioxide may be used as an additional gasifying agent. The raw gas produced by the gasification becomes available at temperatures between about 350° and 800° C. and its most important gaseous components are hydrogen, carbon oxides, and methane.

Solid fuel can also be gasified by a treatment with air or oxygen-enriched air in a mixture with water vapor. This treatment results in so-called lean gases, which have a relatively low calorific value of about 1200 to 200 kcal per standard cubic meter of dry gas and are particularly suitable for use in room-heating furnaces as well in power plants, e.g., in a combined gas turbine and steam turbine process.

In dependence on the composition of the gasifying agent, the gases produced by a gasification of solid fuels under superatmospheric pressure contain also nitrogen, water vapor and considerable quantities of hydrocarbons which differ in kind and boiling range, also ammonia and compounds of sulfur. The raw gas also contains dust-like to fine-grained entrained particles of the fuel and/or ash. The contents of fine-grained or dust-like solids in the raw gas depend mainly on the loading of the gasification reactor, on the behavior of the fuel during the gasification, and on the proportion of fine-grained material in the fuel to be gasified. The trend toward gas producers having higher output rates has resulted in an entraining of more fine-grained solids in the raw gas. It is not unusual for the raw gas to contain more than about 10 g dust per standard cubic meter and it is necessary to collect dust from such gas before it can be used, e.g., in machines.

It is an object of the invention to derive a gas which has a high heating value and a minimized dust content from the raw gas produced by the gasification of solid fuel under superatmospheric pressure. This is accomplished according to the invention in that part of the solids in the raw gas are initially removed therefrom in a coarse purification stage and the gas is contacted in a succeeding intense scrubbing stage with a scrubbing liquid which is at a temperature from about 200° to 300° C. and consists mainly of hydrocarbons and has a water content not in excess of about 5% by weight. In the intense scrubbing stage the gas is scrubbed virtually only with hydrocarbons, which partly evaporate into the gas to increase the calorific value of the gas from which dust is to be scrubbed.

Surprisingly, the gas can be scrubbed with hydrocarbons in such a manner that the residual solids content of the scrubbed gas is within the range which is permissible for machine purity even without requiring the use of substantial quantities of water. If water were used as scrubbing agent in the intense scrubbing stage, too much water vapor would enter the scrubbed gas so that the calorific value of the gas would be much decreased. In the process according to the invention the scrubbing agent used in the intense scrubbing stage preferably does not contain water in excess of about 2% by weight.

Of the hydrocarbons contained in the scrubbing liquid used in the intense scrubbing stage at least about 70% and preferably at least about 85% have suitably a boiling point above about 350° C. One or more Venturi-type scrubbers or radial-flow scrubbers may be used in the intense scrubbing stage. A radial-flow scrubber ensures a particularly low dust content of the scrubbed gas. In the coarse purification stage which precedes the intense scrubbing stage, the raw gas is preferably passed through one or more cyclones so that a major portion of the coarse-grained solids is removed under dry conditions.

An embodiment of the process according to the invention will be explained with reference to the drawing which is a schematic flow sheet of an apparatus for carrying out the novel process.

Referring now more particularly to the drawing, granular solid fuel such as coal supplied through a conduit 2 is gasified in a fixed bed in a gasification reactor 1, known per se, under a pressure of about 5 to 150 bars. The gasification is effected by a treatment with oxygen and water vapor, which are supplied through conduit 3. All or part of the oxygen may be replaced by air. The ash is removed from the reactor through conduit 4.

The raw gas produced by the continuous gasification is at a temperature between about 350° and 800° C. as it leaves the reactor 1 and then flows through a conduit 5 to a dust-collecting cyclone 6. Solids collected in the cyclone are discharged through conduit **7*a*. If the solids in conduit 7*a* have a sufficiently high fuel content, they can be recycled to the reactor 1** in a manner which is not shown.

Raw gas flows from cyclone 6 through conduit 7 to an intense scrubbing stage, which is shown on the drawing to consist of a radial-flow scrubber 8. When the gas leaving the cyclone 6 is at a temperature above 350° C., the gas is desirably cooled before entering the intense scrubbing stage. This can be accomplished most simply in that the gas is sprayed with water in a cooler 9, which is provided with a water supply conduit 10 and, for the sake of precaution, with a drain conduit 11. The cooling prevents a cracking of constituents of the scrubbing liquid as it contacts the prepurified hot gas in the scrubber 8.

In the radial-flow scrubber 8 the gas is sprayed with scrubbing liquid from a distributor 12. Scrubbing liquid is usually supplied at a rate of about 0.5 to 6 liters per standard cubic meter of gas. The scrubbing liquid is supplied through conduit 13. A radial-flow scrubber which is highly suitable for intense scrubbing is described in German Patent No. 2,224,519 and the corresponding U.S. Pat. No. 3,834,127. The radial-flow scrubber ensures that the gas and the droplets of the scrubbing liquid move at a high velocity relatively to each other so that there is a correspondingly high probability for the dust particles to be wetted. As has been explained hereinbefore, the scrubbing liquid consists virtually completely of hydrocarbons, which have been produced by the gasification and are contained in the raw gas. The temperature of the scrubbing liquid is preferably between about 150° to 350° C. and in most cases between about 200° and 300° C. The lower temperature limit is selected to exceed the saturation temperature of the water vapor contained in the gas so that a condensation of said water vapor will be avoided. In the scrubber 8, the gas to be scrubbed flows together with the scrubbing liquid through an annular gap 14, which is variable in width, and subsequently flows outwardly and downwardly along a bell-shaped body 15. The flow path of the gas in the scrubber 8 is indicated by dotted lines 17 and 18.

The mixture of gas and scrubbing agent is conducted in a conduit 20 from the scrubber 8 to a waste-heat boiler 21, in which the mixture is cooled by an indirect heat exchange so that heavy hydrocarbons contained in the gas are condensed. The cooling is so controlled that a condensation of water vapor in the waste-heat boiler 21 is avoided or minimized. The sump 21*a* of the waste-heat boiler may be designed as a cyclone separator for an efficient separation of the purified gas from solids-laden scrubbing liquid. The cooled gas which has been enriched with lower-boiling hydrocarbons leaves the waste-heat boiler through a pure-gas pipe 22. The solids content of the pure gas does not exceed 10 milligrams per standard cubic meter. Before this gas is used as a gas having a high calorific value, e.g., in a power plant process, it may be suitable to collect droplets of hydrocarbons in a drop separator, not shown.

The cooled scrubbing agent flows from the waste-heat boiler 21 into a tar separator 23, in which the various hydrocarbons are separated by gravity in known manner. The solids and the heavy hydrocarbon fraction are collected at the lower end of the tar separator 23 and are withdrawn through a conduit 24 by means of a pump 25. The high-solids fraction, which contains mainly heavy tar, is suitably recycled into the gasification reactor 1 through a conduit 26 which is indicated there. A mixer 27 in the lower portion of the tar separator 23 ensures a homogeneous distribution of the solids in the liquid phase.

The lighter hydrocarbon fraction which becomes available in the tar separator 23 and has only a low solids content is recycled to the scrubber 8 through conduit 13 by means of a pump 28.

The indirect heat exchange in the waste-heat boiler 21 results in a production of water vapor for the gasification in the reactor 1. For that purpose, water is supplied to the waste-heat boiler through conduit 30. Water vapor which has been produced flows through conduit 31 to the gasifying agent conduit 3. Oxygen-containing gas and any additional water vapor are supplied through conduit 32.

The invention will be further described in the following illustrative example.

EXAMPLE

In a process system as shown in the drawing, raw gas at a rate of about 48,000 standard cubic meters per hour was produced under a pressure of 20 bars in a pressure gasification reactor 1 of known type ("LURGI Pressure Gas Producer"). To produce this product gas, the reactor was fed per hour with about 17000 kg granular mineral coal and about 25,000 standard cubic meters of air, to which 0.35 kg water vapor had been added per standard cubic meter of air, as gasifying agent. The raw gas leaving the reactor through conduit 5 had the following composition in % by volume:

$CO_2+H_2S$: 14.4
$H_2$: 22.7
$N_2$: 41.0
CO: 17.1
$CH_4$: 4.2
$C_nH_m$: 0.6

The product gas also contained, per standard cubic meter of dry raw gas:

Tar and oil: 40 g
Light liquid hydrocarbons: 7 g
Water vapor: 0.14 kg
Dust-like solids: 8 g.

The net calorific value of the raw gas was about 1690 kcal per standard cubic meter. The temperature of the raw gas in conduit 5 varied between 520° and 550° C. The raw gas flowed through the dust-collecting cyclone 6 and was cooled to 350° C. by being sprayed with water in the cooler 9 so that the water vapor content of the gas increased to 0.27 kg per standard cubic meter of dry gas. The solids content was reduced to below about 3 g per standard cubic meter. For an intense scrubbing, the gas was sprayed in a radial-flow scrubber with a tarry scrubbing liquid, which was circulated at a rate of about 25 $m^3/h$. 85% of the scrubbing liquids consisted of hydrocarbons which have a boiling point above 350° C.

The pure gas leaving the scrubber 8 contained the gaseous consitutents in unchanged amounts and per standard cubic meter of dry gas contained 0.27 kg water vapor, 7 grams light liquid hydrocarbons and 47 grams tar and oil. The moist gas had a net calorific value of about 1600 kcal per standard cubic meter.

Gas and scrubbing liquid were conducted from the intense scrubbing stage into the waste-heat boiler 21, in which part of the sensible heat was converted into 4200 kg/h high-pressure steam under a pressure of 25 bars by an indirect heat exchange. This steam can desirably be admixed as gasifying steam to the gasifying air without additional compression and can be fed together with said air to the reactor 1. Of the 8750 kg/h water vapor required for the gasification, 4000 kg/h were derived from the water which had been used in known manner to cool the shell of the reactor 1, 4200 kg/h were produced in the waste-heat boiler 21, and the remaining about 550 kg/h were supplied by an extraneous source of water vapor. The pure gas was cooled to 225° C. in the waste-heat boiler 21. Because the water vapor dew point of the pure gas was about 158° C., the gas temperature was sufficiently high to prevent a condensation of water vapor. Scrubbing liquid which had been concentrated by the evaporation of lower-boiling constituents flowed from the sump 21*a* of the waste-heat boiler into the tar separator 23, in which a high-solids, heavier phase and a low-solids, lighter phase were separated by gravity. The lighter phase was re-used as scrubbing liquid in the scrubber 8.

When the example which has been described was altered in that the raw gas was scrubbed with water, the resulting pure gas had a net calorific value of only 1120 kcal per standard cubic meter.

The purified gas produced in accordance with the present invention is directly suitable for use as a fuel in the operation of gas and steam turbines.

It will be appreciated that the instant specification, example and claims are set forth by way of illustration and not limitation, and that various modifications and changes may be made without departing from the spirit and scope of the present invention.

What is claimed is:

1. A process of producing and then using a gas of high calorific value and low dust content comprising contacting a solid fuel with water vapor and free oxygen in a gasification reactor at a pressure of about 5 to 150 bars and a temperature sufficient to produce a gas containing hydrogen and carbon monoxide, containing at least about 8 grams of dust per standard cubic meter and having a temperature of about 350° to 800° C., subjecting the gas to a dry coarse purification to reduce the solids content thereof, intensely scrubbing the gas at about 150° to 350° C. with a scrubbing liquid predominantly comprising hydrocarbons and including less than 2% of water by weight, after said dry coarse purification and before said scrubbing spraying water into the gas thereby to cool it to below 350° C. so as to prevent cracking of constituents of said scrubbing liquid, at least about 70% of said hydrocarbons of the scrubbing liquid having a boiling point above about 350° C., said scrubbing liquid being supplied to the scrubbing stage at a rate of about 0.5 to 6 liters per standard cubic meter of raw gas, withdrawing a purified gas with a solids content not exceeding 10 milligrams per standard cubic meter and having an enhanced calorific value and employing it as a fuel for the operation of at least one turbine, withdrawing used scrubbing liquid from said intense scrubbing stage and cooling it by indirect heat exchange in a cooling zone, separating the liquid from said cooling zone in a tar separator into a high-solids heavy phase and a low solids lighter phase, and using said lighter phase as said scrubbing liquid in the intense scrubbing stage.

2. A process according to claim 1, wherein the coarse purification stage includes at least one cyclone separator.

3. A process according to claim 1, wherein the intense scrubbing is effected in at least one Venturi-type scrubber or radial-flow scrubber.

4. A process according to claim 1, wherein the high-solids heavy phase is fed from the tar separator into the gasification reactor.

5. A process according to claim 4, wherein the high-solids heavy phase is homogenized by a mixer before being fed to the gasification reactor.

6. A process according to claim 1, wherein the coarse purification stage includes at least one cyclone separator, the intense scrubbing is effected in at least one Venturi-type scrubber or radial-flow scrubber, at least about 85% of the hydrocarbons of the scrubbing liquid having a boiling point above about 350° C. The high-solids heavy phase is homogenized by a mixer and then fed to the gasification reactor, the low-solids lighter phase from the tar separator is recycled as scrubbing liquid in the intense scrubbing stage, and the gas leaves the intense scrubbing stage with a calorific value of at least about 1600 kcal per standard cubic meter.

* * * * *

UNITED STATES PATENT AND TRADEMARK OFFICE

CERTIFICATE OF CORRECTION

PATENT NO. : 4,211,539

DATED : Jul. 8, 1980

INVENTOR(S) : Herbert Bierbach et al

It is certified that error appears in the above-identified patent and that said Letters Patent are hereby corrected as shown below:

Column 6, Line 26 Delete "The" and insert --,the--.

Signed and Sealed this

Nineteenth Day of May 1981

[SEAL]

Attest:

RENE D. TEGTMEYER

Attesting Officer

Acting Commissioner of Patents and Trademarks